United States Patent [19]
Morese
[11] 4,245,977
[45] Jan. 20, 1981

[54] METHOD AND APPARATUS FOR HYDROCARBON FLAME IGNITION AND DETECTION

[76] Inventor: Francesco A. Morese, 28 Larcridge La., Ashland, Mass. 01721

[21] Appl. No.: 790,327

[22] Filed: Apr. 25, 1977

[51] Int. Cl.³ ..... F23Q 3/00
[52] U.S. Cl. ..... 431/6; 431/25; 431/78; 328/6
[58] Field of Search ..... 431/6, 25, 59, 78; 328/6

[56] References Cited

U.S. PATENT DOCUMENTS

| | | | |
|---|---|---|---|
| 2,112,736 | 3/1938 | Cockrell | 431/25 X |
| 3,405,998 | 10/1968 | Walbridge | 431/25 |
| 3,879,667 | 4/1975 | Kraty | 328/6 |

*Primary Examiner*—Alan Cohan
*Attorney, Agent, or Firm*—Robert A. Seldon

[57] ABSTRACT

A method and apparatus for hydrocarbon flame ignition and detection is disclosed utilizing a pair of flame-detecting electrodes positioned at the flame site in contact with the flame and in a spaced-apart relationship to accommodate, in the gap therebetween, essentially the flame's reaction zone. At least one of the electrodes may additionally serve as the ignition element and is, accordingly, sufficiently electrically resistive so as to undergo self-heating in response to current flow therethrough.

A second aspect of the invention relates to the direct application of AC line voltage across the resistive electrode during the ignition phase and across the electrode gap during the detection phase.

A third aspect of the invention concerns the thermal-heating of both electrodes by the flame to reduce both the ignition time and the "wall quenching" effect of the otherwise cool electrode surface on the high-conductivity plasma in the reaction zone.

In the detection phase of operation, substantially all of the voltage applied to the self-heating electrode during ignition is impressed across the electrode gap for maximum current flow by a novel switch arrangement. The contacting of the electrodes by flame permits a large current to flow through the gap owing to the high conductivity of the reaction zone and to the low capacitive reactance between the closely spaced electrodes.

19 Claims, 7 Drawing Figures

METHOD AND APPARATUS FOR HYDROCARBON FLAME IGNITION AND DETECTION

BACKGROUND OF THE INVENTION

1. Field of the Invention

This invention relates to a method and apparatus for igniting and detecting a flame in a burner system using a combustable hydrocarbon fuel.

Burner systems of the type forming the environment for the present invention generally include a main burner connected to a supply of combustable hydrocarbon fuel which is ignited by a pilot light. Various control circuits are known in the art for automatically discontinuing fuel flow to the burner if the flame is extinguished or, alternatively, for automatically reigniting the flame.

2. Description of the Prior Art

Flame detection systems using flame conductivity, per se, are known in the art. Flame conductivity, is expressed by the equation $$\sigma = \frac{n_e e^2}{m_e \nu_{e\sim}} \quad (1)$$

where $n_e$≡electron density e≡electron charge $m_e$≡electron mass $\nu$en≡electron-neutral collision frequency The existance of $\sigma$ is due to the presence of electrons (of density $n_e$) which are produced by thermal ionization, according to the well known Saha equation. For typical flame temperatures of 1700° C., $n_e$ is approximately $10^6$ electrons/cm$^3$ at atmospheric pressure, while $\nu$en is approximately $10^{10}$ to $10^{12}$.

Examples of prior art flame detection systems which use flame conductivity may be found in U.S. Pat. Nos. 3,941,553, 3,627,458, and 3,836,316.

In these systems, the flame is disposed between a pair of electrodes, one of which is typically the burner itself and by its conductivity completes an electrical circuit therebetween. Such circuits are characterized by impedances of approximately 50 MΩ and, consequentally, a very small magnitude of current flows through the flame, and must accordingly be considerably amplified prior to use as a controlling signal. It may be readily appreciated that the requirement of high amplification detrimentally effects both the cost and reliability of such systems and that the relatively small current magnitude is undesirable from the standpoint of ambiguous flame identification.

Ignition systems of the prior art generally use spark techniques wherein a spark between an electrode and the burner ignites the combustable fuel in the gap therebetween. These systems require the use of relatively costly and bulky transformers for producing a voltage which is sufficiently high to enable the spark to jump the gap. Additionally, the spark is not a completely reliable ignition source owing to the rapid dissipation of its thermal energy and the relative criticalness of its position within the flame site. Example of such ignition systems may be found in U.S. Pat. Nos. 3,614,280, and 3,766,441.

SUMMARY OF THE INVENTION

The method and apparatus disclosed herein for both igniting and detecting a hydrocarbon flame employs a pair of electrically conductive electrodes contacting the flame and spaced apart across the reaction zone of the flame. During the detection phase of operation, voltage applied across the electrodes causes a substantial current flow owing to the extremely high electron density of the chemically produced plasma associated with the reaction zone of the flame.

In the ignition phase of operation, at least one of the detecting electrodes is utilized as an ignitor element. Accordingly, the electrode is sufficiently self-heating in response to the passage of current therethrough to thermally ignite the combustable fuel in a highly reliable manner.

In accordance with one aspect of the invention, the ignition electrode is coupled to a power source by switching means serially connected between the electrode and one side of the power source, and the detecting electrode is coupled to said one power source side. Consequently, during the ignition phase of operation, the power source is coupled directly across the ignition electrode to cause self-heating and consequent flame ignition, while during the detection phase, the decoupling of the ignition electrode from said one side of the power source impresses substantially all the source voltage across the gap between the electrodes to maximize current flow through the flame.

Further details and advantages of the present invention will become apparent from the following description of its preferred embodiment together with the following drawings which form a part thereof.

DESCRIPTION OF THE PREFERRED EMBODIMENT

Figure 1:
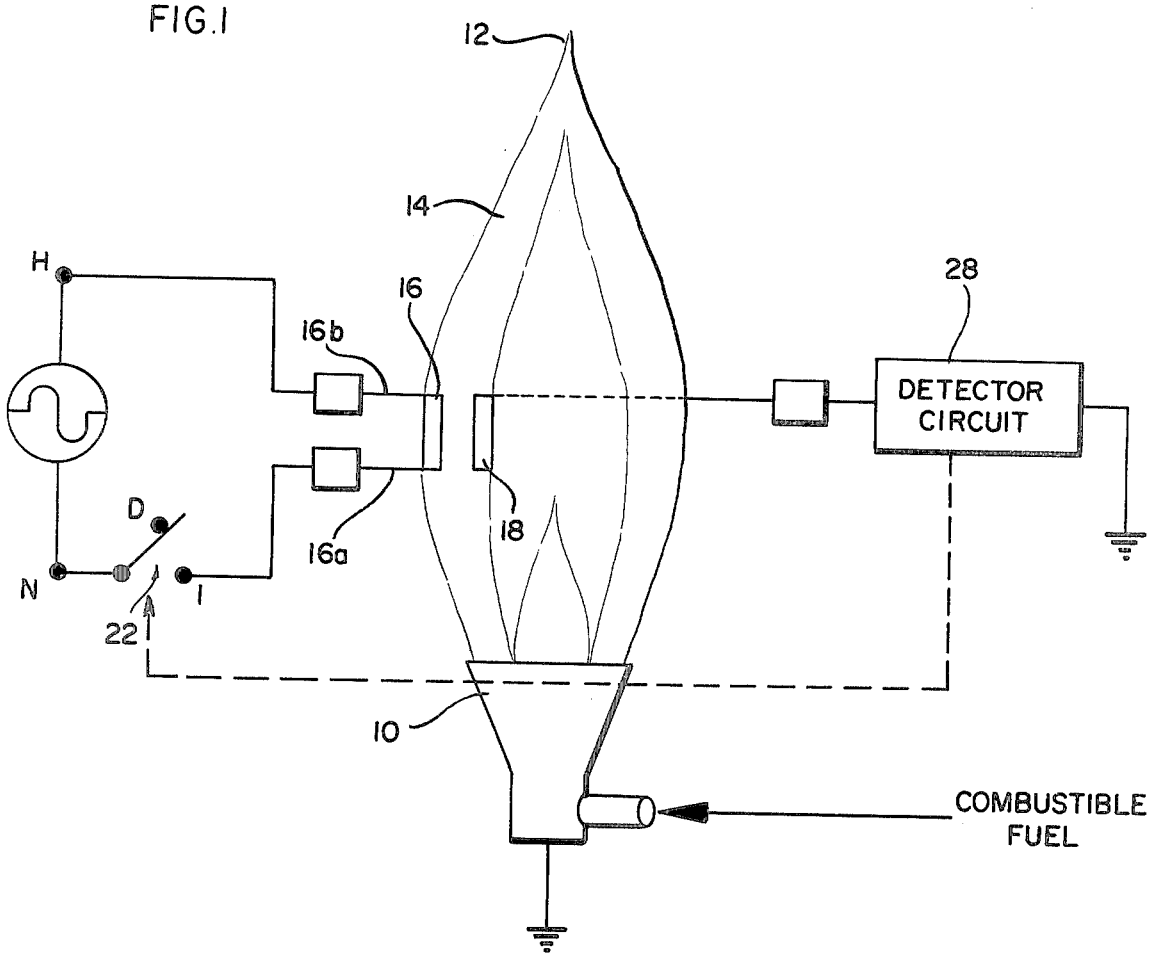
FIG. 1 is a partly schematic diagram of a burner system including a flame ignition and detection system of the present invention.

Referring initially to FIG. 1 there is shown a partially schematic illustration of the flame ignition/detection system in accordance with the invention. A burner 10 is connected to a source of combustable fuel. A flame 12 is disposed in a flame zone above the burner 10. Associated with the flame 12 is a reaction zone 14 which may best be described as a narrow region of high electron-density chemically produced plasma in which the generally predominant electron-producing reactions is believed to be $$CH + O \rightarrow CHO^+ + e^- \quad (2)$$

Although the thickness of the peak electron density region is generally accepted to correspond to the reaction zone ("Ion-Concentration Measurements in a Flat Flame at Atmospheric Temperature" G. Wortberg;

*Tenth International Symposium on Combustion* (1965) p. 651) there is some debate as to the steepness of the electron density profile and the peak electron density ("Self-generated Electrical Fields in Flames"; D. Bradley et. al. *Fourteenth International Symposium on Combustion* (1973) p. 383). For the purpose of this invention, however, it is sufficient to recognize the existance of and utilize the narrow high electrical conductivity region.

In contrast to the electron densities of $10^6$ electrons/$cm^3$ described above with respect to flame conductivity, it has been found that hydrocarbon-air flames have electron densities of $10^{11}$ to $10^{12}$ electrons/$cm^3$ in their reaction zones ("Ionization in Hydrocarbon Flames"; H. F. Calcote; 26th *Meeting of Propulsion and Energetics Panel,* AGARD, Pisa, Italy (1965)).

The mechanism responsible for the high electron densities in the reaction zone is termed, "chemi-ionization" and the principal reaction responsible is given in $$CH+O \rightarrow CHO^{+}+e^{-} \quad (2)$$

It may be readily appreciated that the conductivity of the reaction zone will be some 5 to 6 orders of magnitude higher than that associated with flame conductivity systems of the prior art.

The placement of the electrodes around the reaction zone of, and in contact with, the flame would produce a gap impedance as low as 10 kΩ. The low impedance stems from the conductivity characteristics of the reaction zone, the low capacitive reactance of the narrowly separated electrodes, and from the reduction of wall-quenching effects through the thermal heating of both electrodes by the flame.

As further illustrated in FIG. 1, a pair of spaced-apart electrodes 16, 18 are oriented within the flame so that the reaction zone 14 is located in the gap therebetween. The electrodes are electrically conductive, with the electrode 16 being sufficiently resistive to undergo self heating when a current is passed therethrough. A power source 20, illustratively shown as AC line voltage has its hot side coupled to one end of the electrode 16 and its other neutral side coupled to the other end of the electrode through switching means 22. The second electrode 18 is coupled to neutral or ground through detector circuit 28.

In operation, the switch means 22 is operable between its closed "ignition" (I) and open "detection" (D) positions by the detection circuit in response to the absence and presence of a flame, as further described below. In its "ignition" position, the switch means 22 couples the power source 20 across the electrode 16, causing the electrode 16 to self-heat and ignite the combustible fuel emerging from the burner 10 into the flame zone. When the switching means 22 is open, one end 16*a* of the electrode 16 is decoupled from the neutral side N of the power source 20.

Because the remaining end 16*b* of the electrode 16 remains coupled to the hot side H of the power source 20, and the second electrode 18 is coupled to ground, the voltage of power source 20 is now impressed across the gap between the electrodes 16, 18. Naturally, switching means 22 could alternatively be coupled between the other side 16*b* of the electrode 16 and the hot side of the power source 20, whereupon the electrode 18 would be coupled through the detector circuit 28 to the hot side H of the source 20. As indicated above, the presence of a flame provides a conductive circuit path from the hot side of the power source to ground, or neutral through the reaction zone 14. The high conductivity of the reaction zone, coupled with the application of substantially all the source voltage across the gap, yields a current flow which is substantially larger than that heretofore obtained. To optimize the magnitude of current flow, the electrodes 16, 18 are preferably placed symetrically about the reaction zone and in contact with the flame to minimize flame rectification.

Current, indicative of the presence of the flame 12, is sensed by the detector circuit 28 which operates switch means 22 accordingly. In practice the detector circuit may include a relay coil, having normally closed contacts which are operable as switch means 22. The absence of a flame and the consequential cessation of current flow through the relay coil, causes closure of the contacts and self-heating of the electrode 16.

It may be appreciated that greater advantage of the high conductivity zone 14 is made by employing one of the detector system electrodes as an electrically self-heating resistive or semiconductive ignitor; the elevated temperature of the heated electrode minimizes the "wall quenching" effect on the flame and maintains maximum electron density in the portion of the gap adjacent the heated electrode upon switching to the detecting phase.

As one object of the invention is to provide as simple and, therefore reliable and inexpensive a system as possible, the ignitor is preferably heated directly from line voltage.

As previously indicated, prior art detection systems have used the burner as one electrode. The flame, however, is above the burner and a high impedance air gap is formed therebetween. By contrast, both electrodes of the present invention are in actual contact with the flame, thereby maximizing current flow through the flame.

Figure 2:
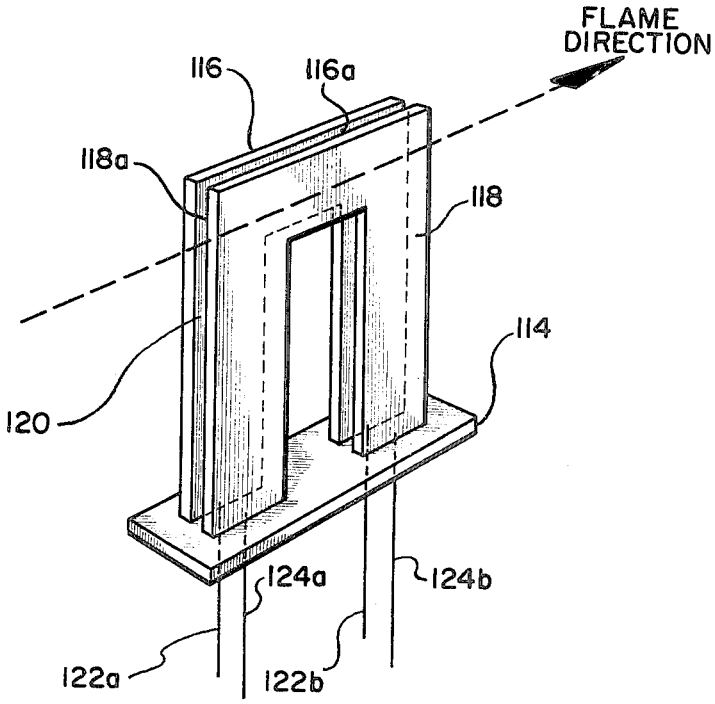
FIG. 2 is a perspective view of an ignition/detection electrode assembly constructed in accordance with the invention.

Turning now to specific electrode assembly configuration, FIG. 2 is a perspective view of a pair of electrically conductive, generally U-shaped plate-like electrodes 116, 118 affixed to a support 114 and having mutually opposing facial surfaces 116*a*, 118*a* spaced apart to defining a gap 120 therebetween. It is desirable to maximize the electrode surface area for reliable ignition and, good flame contact, while minimizing electrode thickness in order to reduce its thermal mass and, consequently, minimize the wall-quenching effects discussed above. In practice the width of the gap is approximately 1 to 8 mm. The size of the entire structure is, of course, dependent on the flame size; an average residential pilot light would require a structure of approximately 1 $cm^2$. At least one, electrode is sufficiently electrically resistive to self-heat when current passes therethrough. Since the electrodes are generally immersed in the flame, they preferably comprise a heat resistant semi-conductive material such as silicon carbide. Connector means 122*a*, *b* and 124*a*, *b* are respectively coupled to the legs of electrodes 116, 118 for electrically coupling thereto. The gap 120 is sized to accommodate essentially only the reaction zone of the flame.

Figure 3:
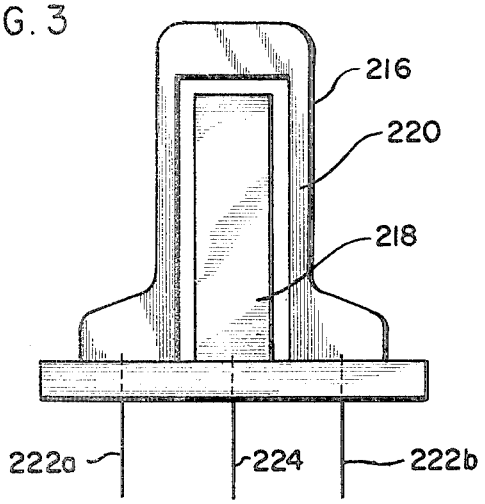
FIGS. 3 and 3A are views of a second electrode assembly constructed in accordance with the invention.
Figure 3A:
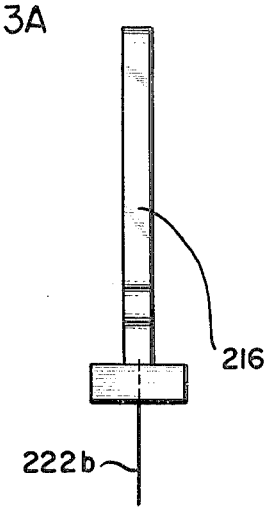

FIG. 3 is a plan view of a second electrode assembly configuration, wherein a first generally U-shaped electrode 216 defies a cavity 220 in which a second plate-like electrode 218 fits. In this embodiment a generally U-shaped gap 220 may be formed in a solid, generally U-shaped piece of electrode material to define an outer electrode 216 and an inner electrode 218 separated by the appropriate distance. Connector means 222*a*, *b* and 224 are provided for electrical coupling to the electrodes 216 and 218, respectively. For the sake of clarity, the flame may be envisioned as rising out of the page, with preferably, part of all its reaction zone passing through the gap.

Figure 4:
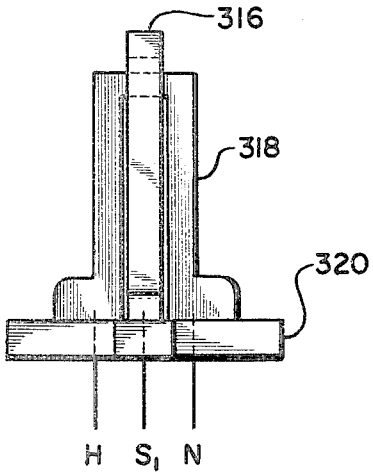
FIGS. 4 and 4A are respectively side elevation views of another electrode assembly in accordance with the invention.
Figure 4A:
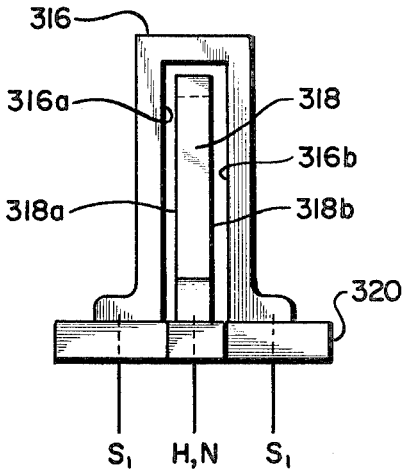

FIGS. 4 and 4A are respectively side and elevation views of a third electrode assembly configuration constructed in accordance with the invention. For the sake of clarity, the flame may generally be envisioned as emerging from the drawing in FIG. 4A. A pair of generally U-shaped plate-like electrodes 316, 318 are affixed to support means 320. The electrodes 316, 318 are rotatingly offset by 90° and approximately sized to enable the straddling of electrode 318 by electrode 316 so that either, or both, of the outer faces 318*a,b* of the electrode 318 are spaced from the inner faces 316*a,b* of electrode 316.

Figure 5:
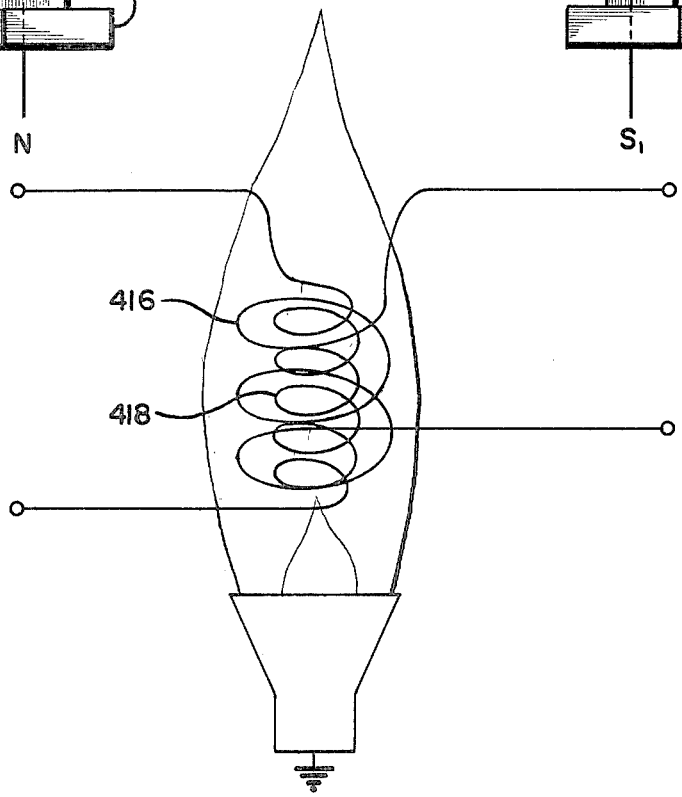
FIG. 5 is a view of another electrode assembly.

FIG. 5 is a view of another electrode assembly of the present invention. The electrode assembly comprises a pair of co-axial coils 416, 418 disposed within the flame parallel to the flame axis and the electrode pair. The coils 416, 418 are close but non-contacting and are preferably coupled by the reaction zone of the flame. The coils may conveniently be formed from a metal such as tungsten or a semiconductive material such as silicon carbide.

While the foregoing description has been concerned with preferred embodiments of the invention, there are many modifications and variations which are obvious to those skilled in the art and are within the scope of the present invention, which is to be limited only by the following claims.

I claim:

1. For use in a hydrocarbon fuel burner assembly of the type including a burner for developing a flame in an adjacent flame zone and means conducting combustible hydrocarbon fuel to the burner, a flame ignition and detection system comprising:

a pair of electrically conductive opposing face members positioned in the flame zone in a spaced-apart, gap-defining relationship to contact a flame occupying the flame zone, one of the face members being sufficiently electrically resistive to self-heat in response to current flow therethrough;

means adapted to coupling a power source across the electrically resistive face member and including switch means for selectively decoupling one end of the electrically resistive face member from one side of the power source;

impedance means for coupling the second face member to said one side of the power source;

the switch means being operable to initially couple said one end of the resistive face member to the power supply to thermally ignite the combustible gas;

the switch means being subsequently operable to decouple said one end of the resistive face member from the power source to impress a substantial portion of the power source voltage across the gap and the impedance means, an electrical circuit path being completed by the presence of the flame, a signal in said circuit path indicative of the presence of the flame being thereby produced; and switch operating means responsive to the absence of the flame indicative signal to operate the switch means and couple said one end of the face member to the power supply to thermally ignite the combustible fuel.

2. The flame ignition and detection system according to claim 1 wherein the means adapted for coupling the power source across the electrically resistive face member couples line voltage directly thereacross.

3. The flame ignition and detection system according to claim 2 wherein the face members are placed essentially symetrically about the high density, chemically produced plasma associated with the reaction zone, thereby minimizing flame rectification and maximizing the electrical conductivity of the gap.

4. The flame ignition and detection system according to claim 1 wherein the face members are generally plate-shaped.

5. The flame ignition and detection system according to claim 1 wherein the face members are formed from semi-conductor material.

6. The flame ignition and detection system of claim 5 wherein the semi-conductive material is silicon carbide.

7. The flame ignition and detection system of claim 1 wherein the face members are spaced apart in the flame zone so that the gap therebetween is sized to accomodate essentially only the flame reaction zone.

8. The flame ignition and detection system of claim 1 wherein the power source is AC line voltage.

9. In a hydrocarbon flame detection system of the type including a pair of electrodes adapted to be coupled across a source of electrical power and wherein the flame is disposed between the electrode pair and by its presence electrically couples the electrodes to permit the flow of a flame-indicative current therebetween, the improvement comprising:

an electrically self-heating electrode as one of the electrodes in said pair; and means responsive to the absence of the flame-indicative current for coupling the self-heating electrode to the power source, the current through the self-heating electrode being of sufficient magnitude to enable the electrode to ignite the flame.

10. A method for igniting and detecting a hydrocarbon flame comprising the steps of:

coupling one electrode to a first side of a power source coupling a self-heating electrode between the first and second sides of the power source to thermally ignite the flame;

decoupling the self-heating electrode from said first side of the power supply subsequent to the ignition phase to impress substantially all the source potential across a gap interjacent the electrodes.

11. A method for igniting a hydrocarbon flame comprising the steps of:

(a) impressing a current through a first self-heating electrode to ignite a burner flame;

(b) discontinuing the current after ignition of the flame and placing the first electrode in circuit with a second electrode spatially positioned in the flame adjacent the first electrode; and (c) detecting the current flowing between said first and second electrodes.

12. The method of claim 11 further including the steps of:

(d) disconnecting the first electrode from the second electrode in response to the absence of current between the electrodes; and (e) repeating steps a-c.

13. The flame ignition and detection system of claim 1 including:

support means; the face members being positioned on the support means and spaced apart from each other to form a pair of electrodes having the gap there between, the gap having a width sized to accomodate essentially the reaction zone of the flame, the electrodes being electrically insulated from each other.

14. The electrode structure of claim 13 wherein the electrodes are formed from a semi-conductive material.

15. The electrode structure of claim 14 wherein the semi-conductive material comprises silicon carbide.

16. The electrode structure of claim 13 wherein the electrodes are generally U-shaped plate-like structures having mutually opposing facial surfaces spaced apart to define a reaction zone-accommodating gap.

17. The electrode structure of claim 13 including a first generally U-shaped electrode having a cavity, and a second electrode fitting within the cavity and spaced from the wall thereof to define a reaction zone-accommodating gap therebetween.

18. The electrode structure of claim 13 including a pair of generally U-shaped electrodes rotatingly offset with respect to each other and sized to enable the straddling of one by the other so that the reaction zone-accommodating gap is defined between the outer surface of the straddled electrode and the inner surface of the straddling electrode.

19. The electrode structure of claim 13 including a pair of generally co-axial coil-shaped electrodes.

* * * * *